US009889369B2

(12) United States Patent
Ruffino

(10) Patent No.: US 9,889,369 B2
(45) Date of Patent: Feb. 13, 2018

(54) SYSTEM AND METHOD FOR A PORTABLE ICE SKATING RINK

(71) Applicant: Brian Ruffino, Buffalo, NY (US)

(72) Inventor: Brian Ruffino, Buffalo, NY (US)

( * ) Notice: Subject to any disclaimer, the term of this patent is extended or adjusted under 35 U.S.C. 154(b) by 0 days.

(21) Appl. No.: 15/260,061

(22) Filed: Sep. 8, 2016

(65) Prior Publication Data

US 2017/0007913 A1 Jan. 12, 2017

Related U.S. Application Data

(63) Continuation-in-part of application No. 14/756,073, filed on Aug. 18, 2014, now abandoned.

(51) Int. Cl.

| | |
|---|---|
| ***A63C 19/10*** | (2006.01) |
| ***A63C 19/08*** | (2006.01) |
| *F25C 3/00* | (2006.01) |

(52) U.S. Cl.

CPC ..... *A63C 19/10* (2013.01); *A63C 19/08* (2013.01)

(58) Field of Classification Search

CPC ... F25C 3/00; F25C 3/02; A63C 19/00; A63C 19/10

USPC ..... 472/88, 90–92, 94; 4/494, 506; 62/235

See application file for complete search history.

(56) References Cited

U.S. PATENT DOCUMENTS

| | | | | |
|---|---|---|---|---|
| 3,933,002 | A | 1/1976 | Vickery | |
| 4,815,301 | A | 3/1989 | Deloughery | |
| 5,622,021 | A * | 4/1997 | Bookout | E04H 3/14 248/351 |
| 5,820,470 | A | 10/1998 | Saunders | |
| 6,517,442 | B1 | 2/2003 | Post | |
| 8,905,853 | B2 * | 12/2014 | Ruffino | F25C 3/02 472/90 |

* cited by examiner

*Primary Examiner* — Kien Nguyen

(74) *Attorney, Agent, or Firm* — Vincent G. LoTempio; Kloss, Stenger & LoTempio; David T. Stephenson

(57) ABSTRACT

A portable ice skating rink structure kit that includes a liner, sidewall, a wicket or slotted anchor block for supporting the sidewall, and sidewall connectors and liner clips. The skating rink may be used on hard or soft surfaces. The sidewall is supported by wickets for use with soft surfaces, such as ground, and slotted anchor blocks for use with hard surfaces, such as pavement. The slotted blocks may have slots of different depths to compensate for uneven ground underneath the skating surface and maintain a sidewall of even height. Once the sidewall is supported, a liner is draped over the playing surface and the sidewalls create a pool of water. The liner may be held in place with liner clips and staples. When temperatures fall below freezing, a smooth sheet of surface ice is created.

15 Claims, 9 Drawing Sheets

SYSTEM AND METHOD FOR A PORTABLE ICE SKATING RINK

This application is a continuation-in-part from application Ser. No. 14/756,073 filed on Aug. 18, 2014.

FIELD

The present disclosure relates generally to privately used home and yard ice rinks for skating and other purposes, and more particularly ice rinks, which are portable that can be easily assembled and disassembled.

BACKGROUND

Ice skating is a popular recreational activity, and there are many variations of activities that can be engaged in on ice skating rinks. The primary activities engaged in on ice skating rinks are recreational ice skating, the game of hockey, curling, figuring skating, and ice dancing. At one time, these activities were performed on "home" ice skating rinks, which primarily took place on frozen ponds, streams, and other naturally occurring bodies of water. With each of these "home" rinks, there is a real and ever present danger, especially with young children, of death by drowning and/or overexposure upon falling through ice, which is too thin to bear the load, applied. In order to eliminate the danger of "home" ice skating rinks, public ice skating rinks started being developed along with shallow portable ice skating rinks.

Issues soon arose with the public ice skating rinks as they typically require that a person go to a nearby public ice skating rink, and these facilities are not always accessible for ice skating depending on factors such as organized hockey and other private function schedules at the outdoor public ice skating rinks. Weather conditions also affect the availability of outdoor public ice skating rinks, as inclement weather may temporarily close the ice skating rinks. Public ice skating rinks also may not be proximate or accessible from one's residence. Additionally, the cost of renting ice time is very expensive, with limited availability times. Many of the availability times being either very early in the morning or very late at night, inconvenient for most people, especially those with little children or a busy work schedule.

Issues also arose with the portable ice skating rink. Some original portable ice skating rinks were made of wood, which made them difficult to assemble, cumbersome, took up a lot of storage space, limited design creativity and were expensive to maintain and were damaging to the grounds. Then came portable ice skating rinks that used long plastic tubing, such as PVC piping with elbow joints. Once again the portable ice skating rink was cumbersome, took up a lot of storage space, had limited design creativity and were expensive to purchase and maintain all the required components. Other portable ice skating rinks have added on or modified previous portable ice skating rinks by varying or adding such elements as: 4"×4" lumber pieces; curb-like structural members, wood beams and bolts; flexible metal; mini boards with triangular back supports; water inflatable tubes; slit corrugated tubes; extruded panels; with various forms of connectors and liners. Each of these variations, add-ons or combinations resulted in portable ice skating rinks to be even more expensive, cumbersome, difficult to assemble, maintain, or caused damage to the grounds.

Thus, a heretofore unaddressed need exists in the industry to address the aforementioned deficiencies and inadequacies.

SUMMARY

The present disclosure provides a system and method for a portable ice skating rink, which is not expensive, nor cumbersome, nor difficult to assemble or maintain and does not cause damage to the grounds. Traditional portable ice skating rinks have comprised of such variations or combinations such as using lumber pieces and bolts; curb-like structural members such as PVC piping; flexible metal; mini boards with triangular back supports; water inflatable tubes; slit corrugated tubes; extruded panels; all with various forms of connectors and liners. Each of these variations or combinations resulted in the traditional portable ice skating rinks to be more expensive, cumbersome, difficult to assemble or maintain and damaging to the grounds.

Briefly described, the present disclosure describes a portable ice skating rink that uses slotted anchor blocks, or wickets, which are placed at locations on a horizontal surface. Slotted anchor blocks are to be used on hard surfaces and wickets used on soft ground. The wall of the device is comprised of an interlocking mechanism and is connected and placed within the slotted anchor blocks to define the shape of the hockey rink. In one embodiment wickets are placed along the sidewall, to penetrate the ground and provide support. The wickets may be U or V-shaped, as would be known to one of reasonable skill in the art. A flexible rubber sheet is unrolled and wrapped around the sidewall defining a skating surface area. A liner is placed over the flexible rubber sheet and secured to the sheet and sidewall. Liner clips are used to secure the liner to the sidewall. A liquid is then placed within the liner and frozen, creating a skating surface, wherein a person could do such activities as ice skating.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
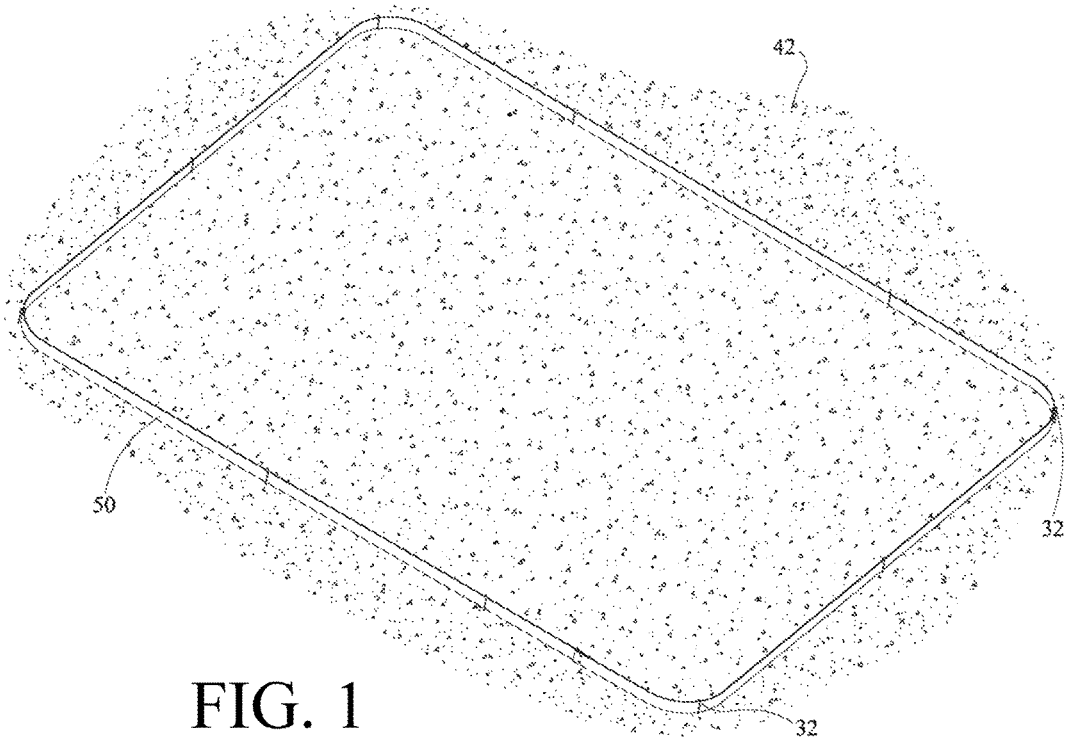
FIG. 1 is a perspective view illustrating an assembled portable ice skating rink in accordance with the claimed invention.

Reference is now made in detail to the description of the embodiments as illustrated in the drawings. While several embodiments are described in the connection with these drawings, there is no intent to limit the disclosure to the embodiment or embodiments disclosed herein. On the contrary, the intent is to cover all alternatives, modifications, and equivalents.

It should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

Currently, it is known that ice skating is a popular recreational activity, and there are many variations of activities that can be engaged on ice skating rinks. Some of the primary activities engaged on ice rinks are recreational ice skating, the games of hockey, curling, figuring skating, and ice dancing. At one time, these activities were performed on "home" ice skating rinks, which primarily took place on frozen ponds, streams, and other naturally occurring bodies of water. With each of these "home" rinks, there is a real and ever present danger, especially with young children, of death by drowning or overexposure upon falling through ice, which is too thin, to bear the load, applied. In order to eliminate the danger of "home" rinks, public ice skating rinks started being developed along with portable ice skating rinks. Issues soon arose though with both public ice skating rinks and portable ice skating rinks.

Public ice skating rinks for the general public typically require that a person or family travel either a short distance or a significant distance to arrive at the public ice skating rinks. Once the person or family arrives at the public ice skating rink it is not a guarantee that the person or family will be able to have access as the ice skating rink may be overcrowded, or being used by organized hockey leagues or other private function schedules. Renting or purchasing ice time to guarantee use is not practical as ice time is very expensive with limited choices in regards to availability, which are typically inconvenient for most people.

Prior portable ice skating rinks also have numerous issues, one being they are bulky as they are typically built of either wood or plastic tubing such as PVC piping with either numerous bolts or connectors. In addition, the prior portable ice rinks are expensive, as they require a user to purchase numerous components, which need to be replaced regularly, making the prior portable ice skating rinks also difficult to maintain and damaging to the grounds. Furthermore, the prior portable ice skating rinks are difficult to assemble because of its bulkiness and numerous components, requiring several people to assist in constructing the prior portable ice skating rinks. Lastly, the prior portable ice skating rinks restrict the type of shape the ice skating rink can be to either a square or rectangle based on the material required to build the prior portable ice skating rinks. Thus, there is a need for a portable ice skating rink wherein the above deficiencies and other deficiencies in the prior art have been obviated in a novel manner by the present claimed invention, as will be more apparent upon studying the remaining disclosure.

Briefly described, the present disclosure describes a portable ice skating rink that uses slotted anchor blocks, or wickets, which are placed at locations on a horizontal surface. Slotted anchor blocks are to be used on hard surfaces and wickets used on soft ground. The wall of the device is comprised of an interlocking mechanism and is connected and placed within the slotted anchor blocks to define the shape of the hockey rink. In one embodiment wickets are placed along the sidewall, to penetrate the ground and provide support. The wickets may be U or V-shaped, as would be known to one of reasonable skill in the art. A flexible rubber sheet is unrolled and wrapped around the sidewall defining a skating surface area. A liner is placed over the flexible rubber sheet and secured to the sheet and sidewall. Liner clips are used to secure the liner to the sidewall. A liquid is then placed within the liner and frozen, creating a skating surface, wherein a person could do such activities as ice skating.

Figure 2:
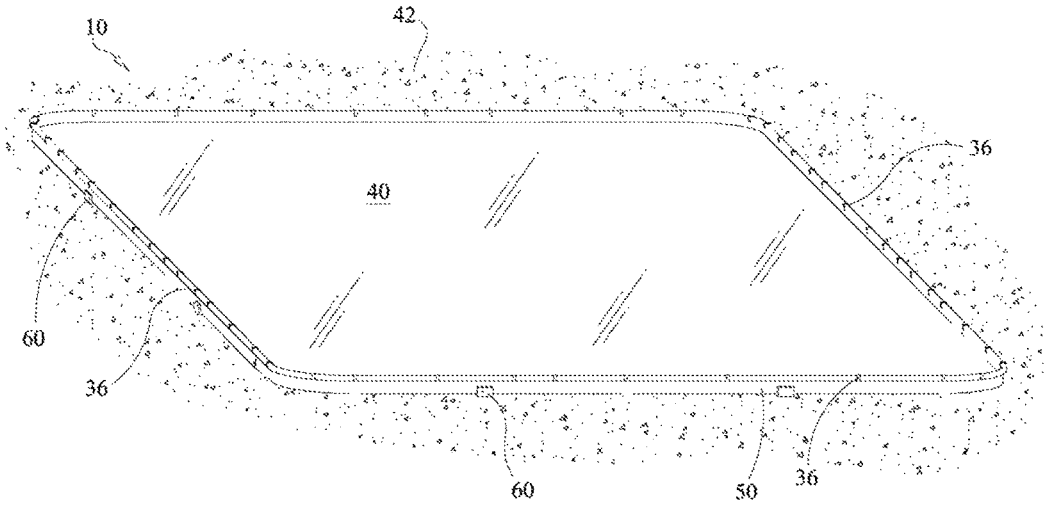
FIG. 2 is a perspective view illustrating an assembled portable ice skating rink including the skating surface in accordance with the claimed invention.
Figure 3:
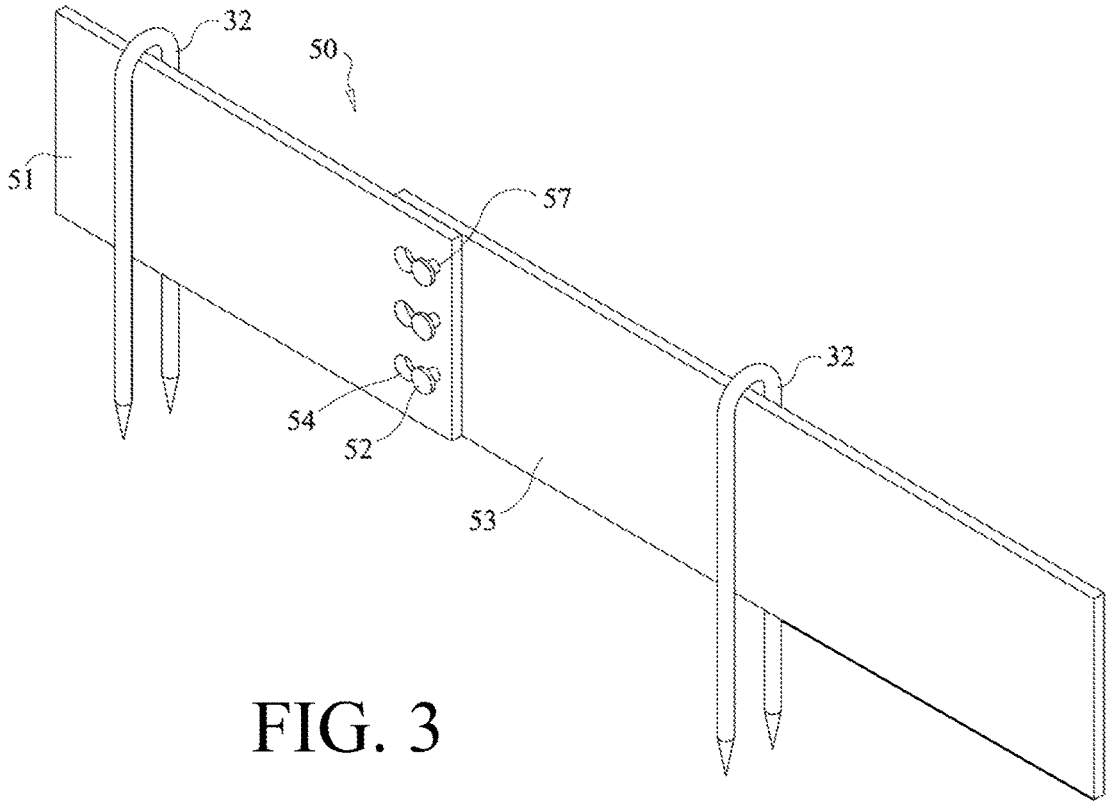
FIG. 3 is a perspective view illustrating the placement of wickets around a sidewall.
Figure 4:
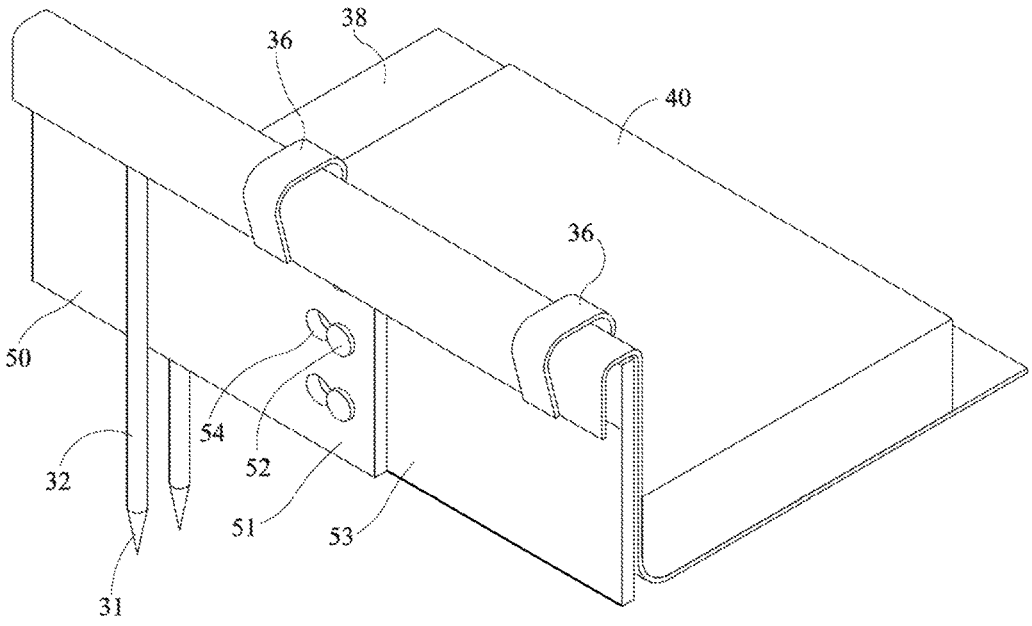
FIG. 4 is a perspective view illustrating an assembly of the portable ice skating rink with wickets hi accordance with the claimed invention.

Adverting now to the drawings, with reference to FIG. 1 shows an initial frame of an embodiment of the portable ice skating rink generally comprising of wickets 32, placed at locations on a horizontal surface 42 to establish a border of a closed geometric shape, wherein a flexible rubber sheet 50 having a first end 51 (as shown in FIGS. 3 & 4) and a second end 53 (as shown in FIGS. 3 & 4) is unrolled (as shown in FIGS. 2 and 4). In one embodiment, wickets 32 are placed along the flexible rubber sheet 50 at regular intervals, thereby defining a skating surface area 40 (as shown in FIG. 1). The first end 51 of the flexible rubber sheet 50 is connected to the second end 53 of the flexible rubber sheet 50, either through the use of an interlocking mechanism 54, 52 as shown in FIGS. 3 & 4 or with nuts and bolts (not shown), thereby forming a sidewall 50.

The number of slotted anchor blocks 60 or wickets 32 can range from at least three to form a triangular ice skating rink to as many as a user needs to form the geometric shape they desire such as a square, rectangle, oval, circle, kidney, free form, and the like. The preferred distance between the slotted anchor blocks 60 or wickets 32 varies depending on the shape and size of the geometric shape, with the smaller or less sophisticated geometric shapes requiring less slotted anchor blocks 60 or wickets 32 and larger or more sophisticated geometric shapes requiring more slotted anchor blocks 60 or wickets 32.

The flexible rubber sheet 50 may be constructed of an EPDM rubber type material or other well-known rubber type of material available to those of ordinary skill in the art. The flexible rubber sheet 50 may come in 50-foot rolls, which allow for easy assembling as the flexible rubber sheet 50 only needs to be unrolled and then wrapped around the sidewall 50. The flexible rubber sheet 50 also allows for easy storage, taking up minimum space, as upon dismantling the portable ice skating rink 10, the flexible rubber sheet 50 may be rolled up and placed with the other elements of the claimed invention within a 30 gallon tote, a garbage can or the like and stored in the corner of a basement, garage or the like.

FIG. 2 shows a preferred embodiment of the portable ice skating rink of the present claimed invention as indicated generally by numeral 10 is generally comprised of wickets 32, placed at locations on the horizontal surface 42 to establish a border of a closed geometric shape. The flexible rubber sheet 50 having first and second ends 51, 53 (as shown ins FIGS. 3 & 4) is then unrolled and wrapped around the wickets 32, therefore defining the skating surface area 40. The first end 51 and the second end 53 of the flexible rubber sheet 50 are connected either through the use of the interlocking mechanism 52, 54 as shown in FIGS. 3 & 4 which will be described herein below, or using a nut and bolt configuration (not shown) wherein a hole, preferably three holes are located at each end 51, 53 of the flexible rubber sheet 50. The holes are large enough to receive the bolt but not so large as to allow the bolt to pass completely through, and the nut is secured onto the bolt, thus securing the flexible rubber sheet 50 to itself, wherein the sidewall 50 is formed (hereinafter flexible rubber sheet will be referred to as "sidewall").

Figure 5:
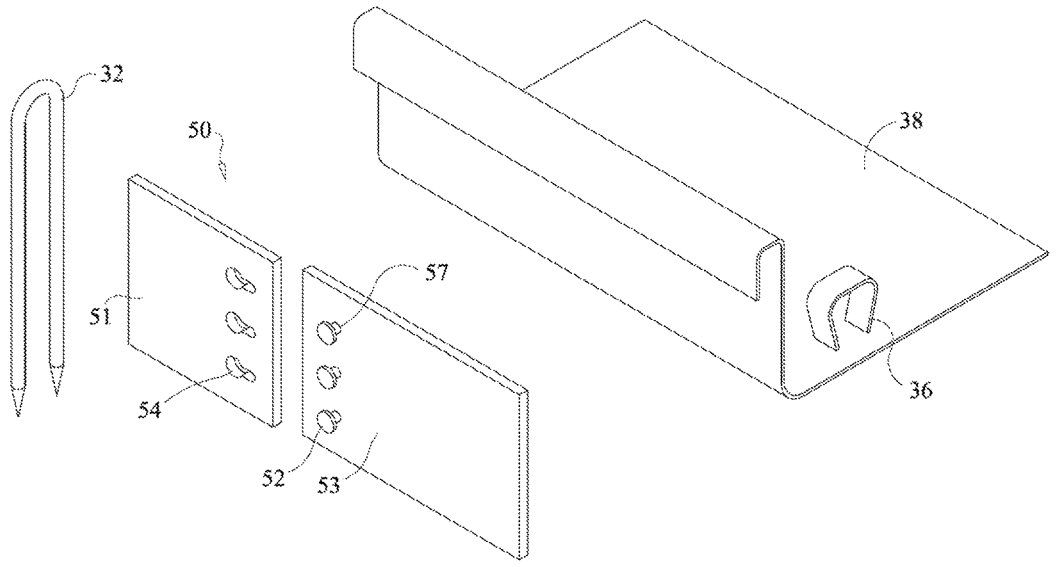
FIG. 5 illustrates an exploded cross-sectional perspective view showing the assembly of a sidewall with wickets.
Figure 6:
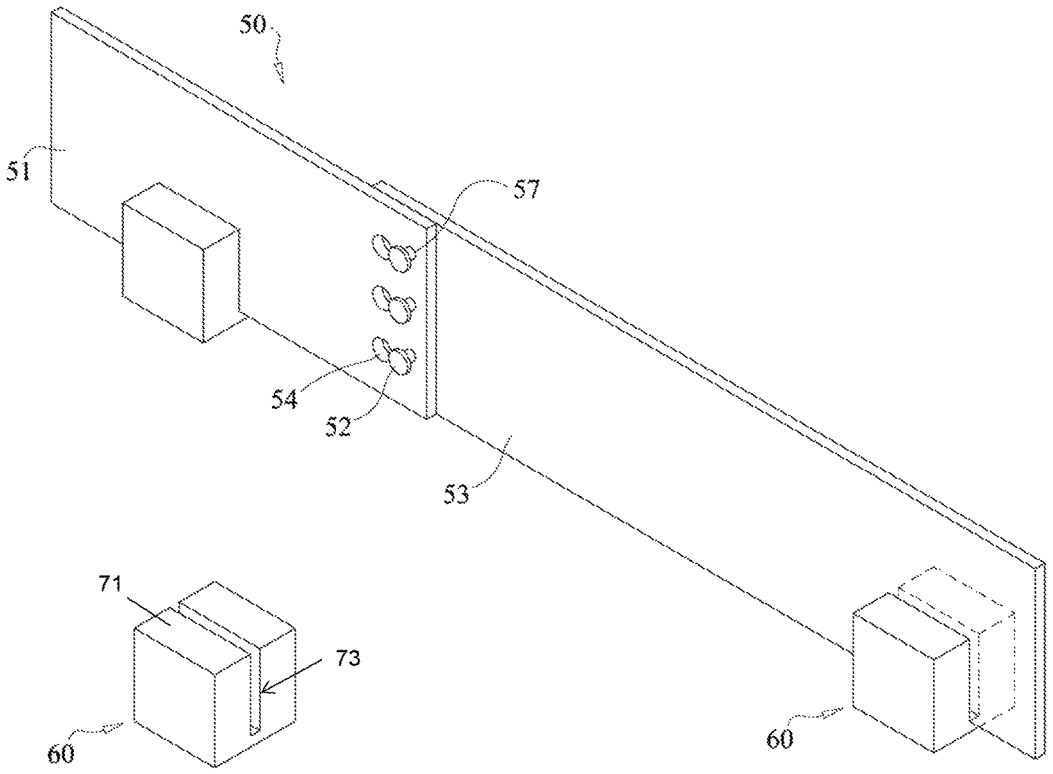
FIG. 6 illustrates a cross-sectional perspective view showing the components of a sidewall with slotted anchor blocks.

In one embodiment, slotted anchor blocks 60 (as shown in FIG. 6) are positioned at a location on the horizontal surface 42 outside and against the sidewall 50. In another embodiment, wickets 52 (as shown in FIGS. 3, 4 and 5) provide support for sidewall 50. A flexible liner 38 is placed on the horizontal surface 42 over the closed geometric shape extending outwardly over the sidewalls 50, thereby forming a liner 38 of a structure capable of containing a liquid. The liner 38 is secured to the sidewall 50 with a liner clip 36. The wickets 32 may be placed at locations on the horizontal surface 42 over and around the sidewall 50 in-between the slotted anchor blocks 60 or wickets 32.

Having completed assembling the portable ice rink 10, the ice building process is ready to begin weather permitting.

Ambient temperatures must be below freezing to effectively build the skating surface area 40, usually requiring close observance of local weather forecasts. Mother Nature's freezing process always commences from the top of the ice and works downward. Thus, rather than filling the liner 38 completely with water, it is preferred to build the skating surface area 40 like the professional . . . a layer at a time. Such a practice eliminates "shell ice" and air entrapment beneath the ice surface, and facilitates regulation of the water to be added so that the existing outdoor temperatures can handle the heat load of the newly applied water in a timely manner. Capitalizing on very cold or night weather during the building process will speed formation of the skating surface area 40. It is recommended that the ice building process be continued until the ice thickness reaches four to six inches or till the ice thickness reaches the top of the sidewall 50. However, the user may fill the liner 38 completely with water WI it reaches the desired thickness and allow the skating surface area 40 to freeze solid creating a skating surface 40.

FIG. 3 shows a cross sectional view of the one embodiment of the claimed invention illustrating wickets 32 supporting sidewall 50. The sidewall 50 has first end 51 and second end 53 and the ends 51, 53 may be connected through the use of an interlocking mechanism 52 & 54. The interlocking mechanism comprises a male connector 52 as part of the second end 53 and a female connector 54 as part of the first end 51. The connectors 52, 54 may also comprise a shape including rounded lobe-shaped connectors, dovetail connectors and polygonal geometric connectors. Each lobed shaped male connector 52 is shaped to fit into the female connector 54, thereby interlocking the sidewall 50. The female connector 54 has a hole or a throat, which is capable of receiving the male connector 52. The throat may be of the shape of a teardrop, which narrows to interlock with a narrow neck 57 (as shown in FIG. 4) on the Male connector 52 to lock the sidewall 50 securely together. If desired the male 52 and female 54 connectors can be made with a slight interference fit with one another or with molded in detents to form an even more secure attachment between the sidewall 50. The connectors 52, 54 may be virtually any geometric shape, diamond, triangle, hexagon, they could even be curved or irregularly shaped as long as the connectors are allowed sufficient clearance to interlock.

The flexible, water-proof slip 38 is placed on the horizontal surface 42 (as shown in FIG. 4) over the closed geometric shape extending outwardly over the sidewalls 50, thereby forming the liner 38 capable of containing a liquid. The liner 38 is secured to the sidewall 50 with liner clips 36.

The wicket 32 may comprise of a first end 31 and a second end 33 (as shown in FIG. 4). The first end and second end are shaped to penetrate the ground. The wicket 32 may be placed at locations on the horizontal surface 42 outside and against the sidewall 50. The wicket 32 provides additional support to the sidewall 50 preventing the sidewall 50 from buckling during the ice building process as described above in FIG. 2.

FIG. 5 shows an exploded cross sectional view of the components of the portable ice skating rink 10. The wickets 32 shown in FIG. 3 and FIG. 5 may be made of steel or other well-known sturdy materials available to those of ordinary skill in the art. The length of the wickets 32 may vary in size depending on user's choice of flexible rubber sheet 50.

The flexible rubber sheet 50 or also known throughout the claimed invention as the sidewall 50 and may be constructed of an EPDM rubber type material or other well-known rubber type of materials available to those of ordinary skill in the art. The dimensions of the flexible rubber sheet 50 is preferably twelve inches in height and a thickness of ⅛ inch to 1/16 inch durometer of 80 and the length may vary depending on the size of the desired playing area as defined by the user. The sidewalls 50 may be stored and packaged in fifty-foot sections and in tightly compacted rolls. The flexible rubber sheet 50 may also have the interlocking mechanism 52, 54 as described above in FIG. 3 or it may have numerous holes preferably three located at the first end 51 and second end 53 of the flexible rubber sheet 50, where currently the interlocking mechanism 52, 54 is located. These holes in the flexible rubber sheet 50 are of the size capable of receiving a standard size bolt, which is thread through the holes and a nut is connected to the bolt securing the two ends 51, 53 of the flexible rubber sheet 50.

The flexible, water-proof slip 38 or also known throughout the claimed invention as the liner 38 may be constructed of a water impermeable barrier such as Tyvek type material, vinyl tarp type material, or elastomers such as polybutadiene, polyisoprene, natural rubber, poly(butadiene-styrene), poly(butadiene-acrylonitrile), polyurethane, polyethylene-propylene) or polyethylene-propylene-non-conjugated diene) and the like, or fabric coated with such elastomers or with the above mentioned plastics, or other well-known water impermeable barriers available to those of ordinary skill in the art. The liner 38 may vary in size depending on the size of the desired skating surface area 40 defined by the user.

The liner clips 36 are preferably an aluminum, wood, or plastic clip or other well-known materials available to those of ordinary skill in the art. The preferred size of the liner clips 36 is of the size of one to three inches. However, the size of the liner clip 36 may vary depending on the thickness of the flexible rubber sheet 50 and the flexible, water-proof slip 38.

When setting up the portable ice skating rink of the claimed invention it is advisable to seek a substantially leveled ground or surface, free of any debris. The method of the claimed invention comprises of first, placing slotted anchor blocks 60, or in the alternative wickets 32, at locations on the horizontal surface 42 to establish a border of a closed geometric shape. Next, the flexible rubber sheet 50 having first and second ends 51, 53 is unrolled and then inserted into the slotted anchor blocks 60, or in the alternative along wickets 32, thereby defining the skating surface area 40. The first end 51 of the flexible rubber sheet 50 is connect to the second end 53 of the flexible rubber sheet 50 by the interlocking mechanism 52, 54 or with nuts and bolts, thereby forming a sidewall 50. Wickets 32 are then places along the flexible rubber sheet 50. The flexible, water-proof slip 38 is then placed on the horizontal surface 42 over the closed geometric shape and extending beyond the sidewalls 50, thereby forming the liner 38 of the portable ice skating rink 10 capable of containing liquid. Liner clips are then used to secure the liner 38 to the sidewall 50. The liquid is then placed within the liner 38 during below freezing temperatures, thereby freezing the liquid and creating the skating surface 40.

One embodiment of the present disclosure has U or V shaped support wickets that provide sidewall support on a ground surface. Another embodiment incorporates a slotted anchor block 60 that holds the sidewall.

FIG. 6 shows the assembly with sidewall 50 placed in standard slots 73 of sidewall anchor block 60. Standard slot 73 extends from top surface 71 of sidewall anchor block 60 through approximately the entire sidewall anchor block 60. A standard slot 73 may preferably be of a depth of 5 inches on a 6 inch sidewall anchor block.

Figure 7:
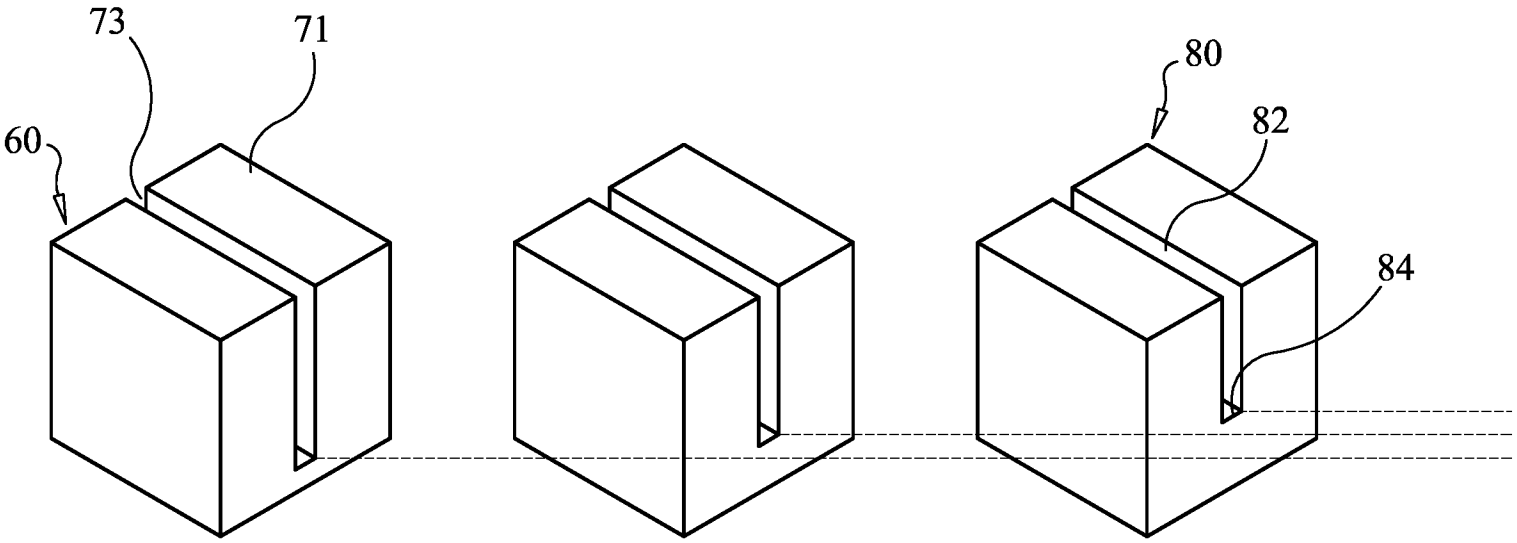
FIG. 7 illustrates a perspective view showing leveling slotted anchor blocks.

FIG. 7 shows an embodiment of the present disclosure including leveling slotted anchor blocks 80. A slotted anchor block 60 is shown on the left, where standard slot 73 extends from top surface 71 of sidewall anchor block 60 through approximately the entire sidewall anchor block 60. To the right of slotted anchor block 60 are shown leveling slotted anchor blocks 80 including leveling slots 82, which have raised portions at the bottom of the slot referred to as leveling surface 84. Whereas a standard slot 73 may be of a depth of 5 inches on a slotted anchor block 60 of 6 inches in height, a leveling slot 82 on a levelling slotted anchor block could preferably be of 1 inch depth, thereby providing compensation for a 4 inch drop in the horizontal surface on which the assembly is placed. Leveling slotted anchor blocks 80 may, in some embodiments, have leveling slots 82 of varied depth to compensate for varied changes in ground height. Leveling surface 84 at the bottom of leveling slots 82 may be raised to different levels based on need.

Figure 8:
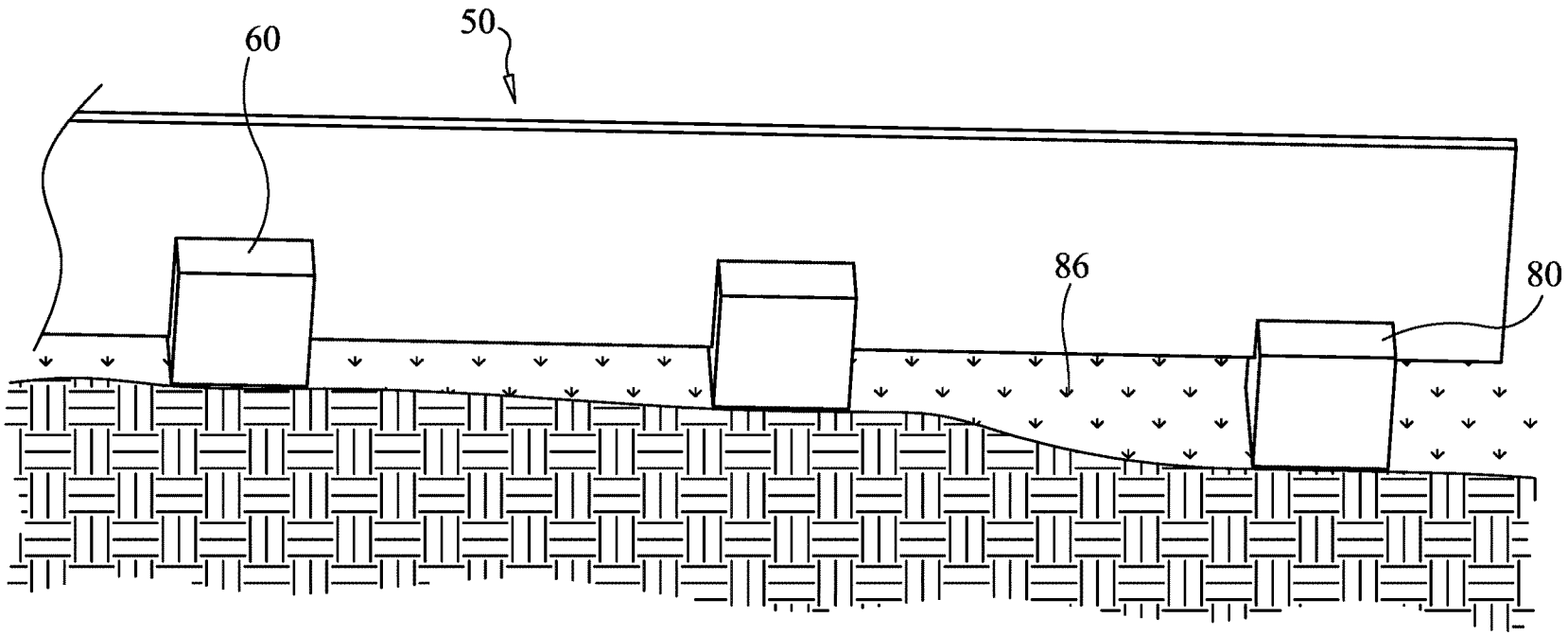
FIG. 8 illustrates a side view of the assembly on uneven ground showing compensation with leveling slotted anchor blocks.

FIG. 8 shows the assembly on uneven ground 86, with sidewall 50 attached to sidewall anchor block 60 on the left and leveling anchor blocks 80 to the right. Leveling sidewall anchor blocks 80 compensate for uneven ground 86 to provide a generally level sidewall 50 for the assembly.

Figure 9:
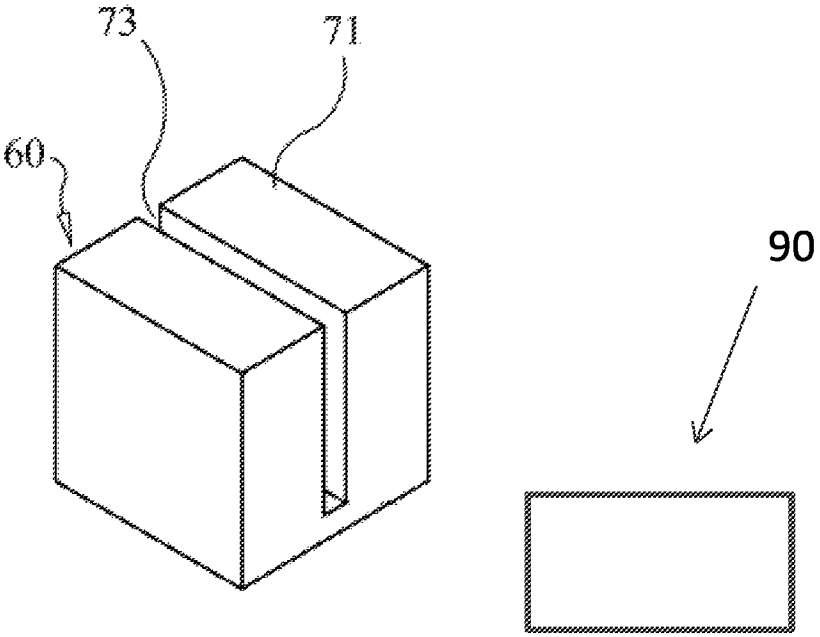
FIG. 9 illustrates a perspective view of a leveling adapter which may be placed into a standard slot in the block.

As shown in FIG. 9, in an alternative embodiment, a leveling adapter 90 may be placed into a standard slot 73, or a slot adapted for accepting a leveling adapter, to transform a standard slot 73 into a leveling slot. The leveling adapter 90 may be inserted into standard slot 73 to raise the lower level of the slot and may be held in place by friction, clipping or other means. Once in place, leveling adapter 90 may support the flexible sheet that forms the sidewall.

Although exemplary embodiments have been shown and described, it will be clear to those of ordinary skill in the art that a number of changes, modifications, or alterations to the disclosure as described may be made. For example, the slotted anchor block may have small holes located approximately to the bottom of the slotted anchor block capable of receiving sidewall anchor bolts and the slotted anchor block may be constructed of wood. In addition bands may be placed in-between the ice sheets to create lines such as those on a hockey rink. All such changes, modifications, and alterations should therefore be seen as within the scope of the disclosure.

What is claimed is:

1. A portable ice skating rink comprising:

supports at locations on a horizontal surface to establish a border of a closed geometric shape, wherein each of said supports has a slot for accepting a flexible sheet having a first end and a second end;

wherein at least one support is a leveling support, said leveling support having a leveling slot with a different depth than a standard slot such that the leveling slot is capable of compensating for an uneven horizontal surface on which the supports are placed in order to maintain the flexible sheet at a consistent height when the flexible sheet is placed into the slots;

the flexible sheet having a first end and a second end;

wherein the flexible sheet is removably attached to the supports;

wherein the first end of the flexible sheet is removably attached to the second end of the flexible sheet thereby forming a sidewall;

a flexible, water-proof slip placed on said horizontal surface over the closed geometric shape and extending beyond the sidewalls, thereby forming a liner of a structure capable of containing a liquid;

wherein the liner is secured to the sidewall.

2. The portable ice skating rink of claim 1, wherein the supports are slotted anchor blocks.

3. The portable ice skating rink of claim 2, wherein, the slotted anchor block is generally rectangular shaped having a first front surface, a first side surface, a second side surface, a rear surface, a bottom surface, a top surface, and a slot opening to said first side surface, said second side surface and said top surface.

4. The portable ice skating rink of claim 1, wherein the flexible sheet is comprised of rubber.

5. The portable ice skating rink of claim 1, wherein a wicket secures the sidewall to the horizontal surface.

6. The portable ice skating rink of claim 5, wherein the wicket has a first end and a second end, the first end having a shape of a rod and the second end having a shape rod where both ends are of generally similar size and separated by a central bend allowing the end to contact the horizontal surface on each side of the sidewall.

7. The portable ice skating rink of claim 1, wherein an interlocking mechanism having at least one connector, the connector being selected from the group consisting of a male connector and a female connector, the male connector being a projection from the flexible rubber sheet located at either the first end or the second end of the flexible rubber sheet, the female connector being a hole located at the opposite end of which the male connector is located on the flexible rubber sheet.

8. The portable ice skating rink of claim 7, wherein the projection of the male connector has a narrow neck connecting the projection to the flexible rubber sheet and the hole of the female connector has a narrow throat.

9. The portable ice skating rink of claim 1, wherein the interlocking mechanism of the sidewall comprises holes capable of receiving a bolt.

10. The portable ice skating rink of claim 1, wherein the liner is connected to the sidewall with a liner clip.

11. The portable ice skating rink of claim 1, further comprising a plurality of staples removably attached to the liner and the flexible sheet to reinforce attachment of the liner to the flexible sheet.

12. The portable ice skating rink of claim 1, wherein a bottom of the standard slot is between 0.5 inches and 1.5 inches from the horizontal surface and a leveling surface of the leveling slot is between 3 inches and 5 inches from the horizontal surface.

13. A method of assembling a portable ice skating rink, the method comprising the steps of:

placing supports at locations on a horizontal surface to establish a border of a closed geometric shape, wherein each of said supports has a slot for accepting a flexible sheet having a first end and a second end; wherein at least one support is a leveling support, said leveling support having a leveling slot with a different depth than a standard slot such that the leveling slot is capable of compensating for an uneven horizontal surface on which the supports are placed in order to maintain the flexible sheet at a consistent height when the flexible sheet is placed into the slots;

placing the flexible sheet having a first end and a second end into the supports;

connecting the first end of the flexible sheet to the second end of the flexible sheet thereby forming a sidewall;

placing a flexible, water-proof slip on said horizontal surface over the closed geometric shape and extending beyond the sidewalls, thereby forming a liner of a structure capable of containing a liquid;

securing the liner to the sidewall;

placing a liquid within the structure; and freezing the liquid to create a skating surface.

14. The method of claim 13, further comprising the step of inserting a leveling adapter into the standard slot of the support to form an adapted leveling surface.

15. The method of claim 13, wherein the support is a slotted anchor block.

* * * * *